US008955673B2

(12) United States Patent
Sauter et al.

(10) Patent No.: US 8,955,673 B2
(45) Date of Patent: Feb. 17, 2015

(54) FREE-STANDING INSTRUMENT VITRINE

(76) Inventors: Ryan Patrick Sauter, La Crosse, WI (US); Adam Daniel Jacobson, La Crosse, WI (US)

( * ) Notice: Subject to any disclaimer, the term of this patent is extended or adjusted under 35 U.S.C. 154(b) by 353 days.

(21) Appl. No.: 13/191,101

(22) Filed: Jul. 26, 2011

(65) Prior Publication Data

US 2012/0024728 A1 Feb. 2, 2012

Related U.S. Application Data

(60) Provisional application No. 61/368,087, filed on Jul. 27, 2010.

(51) Int. Cl.

| | |
|---|---|
| ***A45C 11/00*** | (2006.01) |
| ***G10G 7/00*** | (2006.01) |
| *B65D 5/42* | (2006.01) |
| *A47F 7/00* | (2006.01) |

(52) U.S. Cl.

CPC ..... *G10G 7/00* (2013.01); *B65D 5/4204* (2013.01); *A47F 7/00* (2013.01); *G10G 7/005* (2013.01)

USPC ..... 206/14; 206/45.24; 206/314

(58) Field of Classification Search

CPC ..... G10G 7/005; A47F 7/00; B65D 5/4204

USPC ..... 206/14, 204, 314, 776, 782, 45.24, 764; 84/453; 29/428

See application file for complete search history.

(56) References Cited

U.S. PATENT DOCUMENTS

| | | | | |
|---|---|---|---|---|
| 971,060 | A * | 9/1910 | Lynch | 206/45.24 |
| 4,147,254 | A | 4/1979 | Bruce | |
| 5,590,771 | A * | 1/1997 | Cota | 206/314 |
| 5,833,051 | A * | 11/1998 | Tiefenbrun et al. | 206/14 |
| 5,927,487 | A * | 7/1999 | Whittle et al. | 206/45.2 |
| 6,135,277 | A * | 10/2000 | Armstrong | 206/314 |
| 6,209,717 | B1 * | 4/2001 | Flynn | 206/204 |
| 6,462,260 | B2 * | 10/2002 | Fediakov | 206/314 |
| 6,612,483 | B2 * | 9/2003 | Harris et al. | 206/314 |
| 6,685,283 | B2 | 2/2004 | Gembar et al. | |
| 6,959,810 | B2 * | 11/2005 | Neilson | 206/314 |
| 7,090,313 | B1 | 8/2006 | McMurray | |
| 7,290,653 | B2 * | 11/2007 | Izen et al. | 206/314 |
| 8,207,434 | B2 * | 6/2012 | Klemp | 206/314 |
| 2003/0192795 | A1 * | 10/2003 | Izen et al. | 206/314 |
| 2006/0226037 | A1 | 10/2006 | Field | |
| 2008/0047855 | A1 | 2/2008 | Iszen | |
| 2010/0012739 | A1 | 1/2010 | Hoeth | |

OTHER PUBLICATIONS

Web page entitled "Gem Cases," from a Web site for a business identified as Guitar Humidor LLC; the publication date of the Web page and Web site is unknown; the Web page entitled "Gem Cases" was retrieved Oct. 17, 2011 from http://www.guitarhumidor.com/cases/gem; records published on-line by the State of Illinois recite that the "Filing Date" for Guitar Humidor LLC was "Jan. 5, 2010", two (2) pages.

(Continued)

*Primary Examiner* — Luan K Bui

(57) ABSTRACT

A free-standing vitrine for storing instruments is disclosed. The vitrine comprises a transparent portion through which an instrument stored inside the vitrine is viewable when the lid of the vitrine is closed. Furthermore, versions of the free-standing vitrine may be inclined relative to the surface on which the vitrine rests.

10 Claims, 3 Drawing Sheets

(56) References Cited

OTHER PUBLICATIONS

A specimen provided to the United States Patent and Trademark Office as part of an application to register the word mark "Guitar Humidor." According to the Patent Office's on-line Trademark Electronic Search System, the applicant seeking to register this word mark provided this specimen as part of Trademark/Service Mark Application No. 77905718, filed on Jan. 6, 2010. The applicant provided the following Specimen Description in the application: "advertisement in Acoustic Guitar Magazine for Guitar Humidor to show commercial use.", two (2) pages.

* cited by examiner

FREE-STANDING INSTRUMENT VITRINE

This application claims priority to U.S. Provisional Patent Application No. 61/368,087, which was filed on 27 Jul. 2010 and is entitled "Free-Standing Instrument Vitrine", the substance of which is incorporated herein by reference.

BACKGROUND

Many people love music. People enjoy listening to songs and compositions played by others. Musicians likewise enjoy playing songs and compositions that they and others listen to. Whether a person is a beginner, or a professional, all appreciate not only the sounds being played, but also the beauty of the instrument being played.

The appearance of an instrument, and the quality of the music played on it, depend, in part, on how the instrument is stored. If, for example, the instrument is not stored, but instead left unattended, then it may be damaged or marred. Furthermore, some instruments, such as a violin or guitar, may sound differently depending on environmental conditions (e.g., depending on the temperature, humidity, or other factor). At worst, some instruments made of wood may dry out, or suffer damage, if surrounding environmental conditions are extreme.

Accordingly, many people store instruments in portable cases. Such cases are convenient. They may be used, for example, to transport an instrument from home to another location for a performance or practice session. Furthermore, when the instrument is not being used, then it may be left in the portable case, thereby providing some level of protection. Because a portable case is usually lightweight, however, the level of protection may be less than can be achieved by other materials of construction (e.g., wood, metal, or other materials). Another possible drawback for such cases is that the instrument is out of sight, and, therefore, possibly out of mind. Musicians, whether beginners or experienced, may not play the instrument as frequently if the portable case is stowed under a bed, or in a closet. Even if the case itself is left out in the open—e.g., in the corner of the room—then the instrument inside isn't viewable if the lid of the case is closed.

Some portable cases are designed such that the lid, when opened, also serves to stabilize the case in an upright, possibly inclined position. In this way the instrument, such as a guitar, can be viewed. Of course such configurations may not be particularly stable, because a portable case, as mentioned above, is typically constructed of lightweight materials. Furthermore, such portable cases may not be suitable for heavier instruments that might destabilize the portable case when placed in an upright position. On the other hand, if the instrument contained in the portable case is light (e.g., a violin or guitar), then the portable case and instrument might easily be knocked over. Also, because viewing the instrument necessarily requires that the lid be opened, both so the instrument inside may be seen, and because the lid itself is used to stabilize the portable case in an upright position, any tipping over of the case may damage or mar the exposed instrument inside. Furthermore, if a humidification device is placed in the portable case to help achieve some desired level of humidity inside the case, then humidity control will not work well, if at all, if the lid of the case is open so that the instrument inside is viewable.

Another approach to storing and displaying instruments is to place the instrument in either a wall-mounted display case, or an upright, armoire-like furniture piece positioned next to a wall. While such cases have included a window through which the instrument can be viewed, these cases, once installed, typically cannot be readily moved. Furthermore, such cases are usually restricted to a vertical, upright orientation, in part due to their placement next to a wall. So that a viewer may comfortably see the instrument, these cases may also be large and tall, so that the instrument inside is at a position closer to a standing adult's eye level; or mounted on a wall at or near a typical standing adult's eye level.

SUMMARY

We have invented a free-standing instrument vitrine that is stable, provides for comfortable viewing of the instrument contained therein, and which may be moved to different locations in a room or house.

The free-standing instrument vitrine does not rely on reconfiguring a lid to stabilize the vitrine in an upright position. Accordingly, the lid or door of the vitrine may be made of glass, transparent plastic (e.g., Plexiglas-brand material), or other transparent material through which the instrument may be viewed even when the lid or door is closed.

To facilitate movement of the free-standing instrument vitrine in a room, the vitrine is typically sized to accommodate a particular instrument (e.g., a guitar, saxophone, or violin), yet not be so large as to make the vitrine cumbersome. For those vitrines that house instruments susceptible to changes in environmental conditions (e.g., humidity), sizing the vitrine so that it comfortably accommodates the instrument (and, optionally, other accessories), but not significantly larger, also reduces the interior volume that is conditioned.

Typically the free-standing instrument vitrine is not vertical, but is inclined. An inclined position facilitates viewing of the instrument because the vitrine, when placed on a floor, usually does not rise to the eye level of a typical, standing adult. Furthermore, an inclined position likely increases the stability of the vitrine and the instrument contained therein.

Accordingly, in some versions of the invention, the free-standing instrument vitrine is an inclined container configured to receive and display an instrument. The vitrine includes a lid through which at least a portion of the interior of the container is viewable through the lid. At least a portion of the lid is movably attached to the vitrine (e.g., by a hinge), thereby providing access to the interior of the vitrine when the lid is moved. Some versions of the invention include legs, feet, extensions, or stabilizers to help to stabilize an inclined vitrine position. Also, some versions of the invention include one or more mechanical components inside the vitrine that help support, secure, or restrict movement of an instrument. For example, the vitrine might include a base on which the instrument rests or is supported. The vitrine might include a clasp, slot, clamp, bracket, channel, contoured surface, or other mechanical component that helps support, or restrict the movement of, an instrument placed in the vitrine.

The free-standing instrument vitrine may be made of different materials. In some versions of the invention, the vitrine is made of wood, which provides an aesthetically pleasing look, and may be readily processed to achieve different shapes and configurations. Furthermore, wood is strong, and by virtue of its mass, helps provide stability to the vitrine.

The free-standing instrument vitrine may assume various shapes. In some versions of the invention, the vitrine has a trapezoidal shape. Such a shape helps further stabilize the vitrine, because the bottom of the vitrine is larger than the top. Furthermore, for certain kinds of instruments, such a shape readily accommodates the shape of the instrument itself (e.g., a conventional guitar in an upright position, with a wider, lower portion—the body of the guitar—and a narrower, upper portion—the neck and head of the guitar).

As noted above, the vitrine may also include devices that help control one or more environmental variables characterizing the volume within the vitrine. For example, in some versions of the invention, the vitrine includes a humidification device to help control the relative humidity of the volume inside the vitrine. The vitrine may also include a sensor for detecting an environmental variable, such as relative humidity, inside the vitrine. To help facilitate control of one or more environmental conditions within the vitrine, the inventive article of manufacture may include a gasket assembly or other component that helps ensure a good seal between the lid (or lids) and other portions of the vitrine.

These and other representative embodiments the present invention, and methods for making the present invention, are described below.

DRAWINGS

FIG. 1 shows a front view of one representative version of a free-standing vitrine of the present invention, in this instance with the lid open, and without an instrument placed therein.

FIGS. 2A, 2B, 2C, and 2D show different representative versions of lid configurations that can be employed with a vitrine of the present invention.

DESCRIPTION

Figure 1:
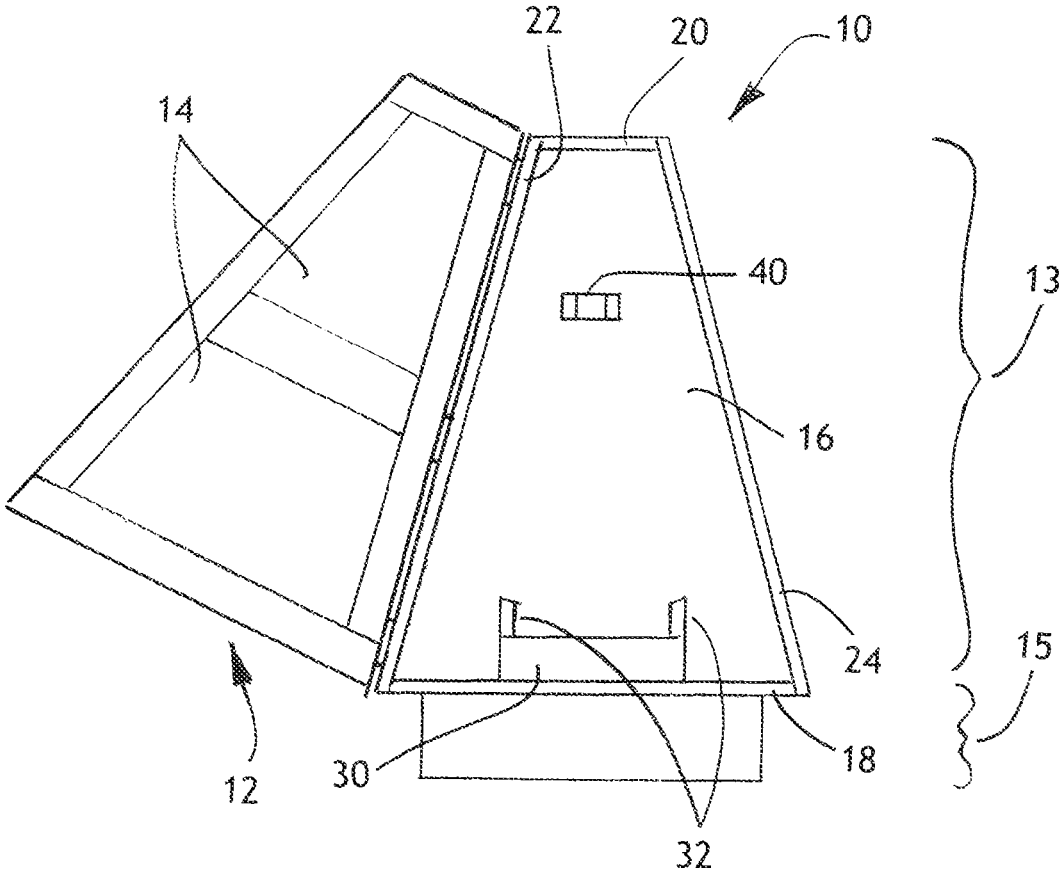

FIG. 1 shows a front view of one representative version of a free-standing vitrine 10 of the present invention (with the arrow extending from the number 10 signifying the vitrine as a whole). In this depiction of the vitrine, the lid 12 is in an open position (with the arrow extending from the number 12 signifying the lid of the vitrine). Because the lid comprises, in the depicted embodiment, a substantially transparent portion 14, at least a portion of the instrument contained therein—in this case a guitar—is viewable through the lid when the lid is closed.

Figure 2A:
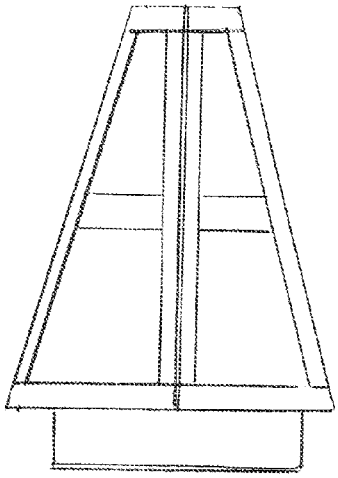
Figure 2B:
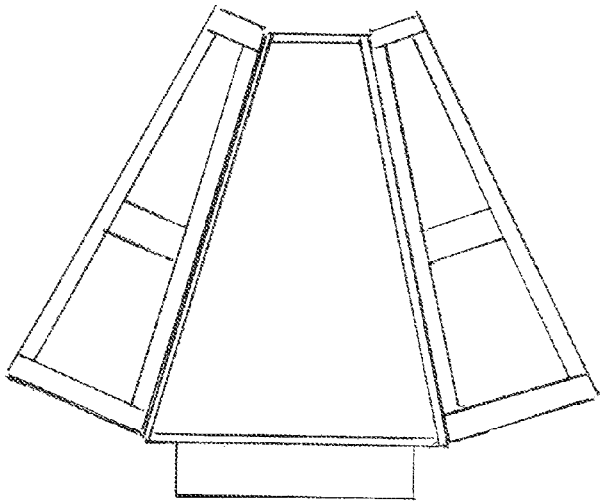
Figure 2C:
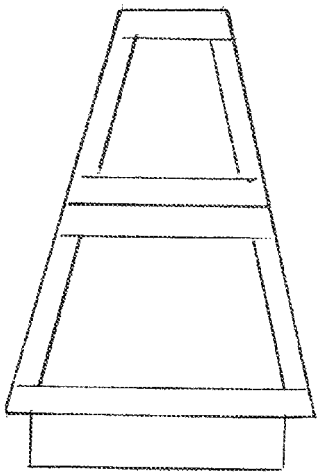
Figure 2D:
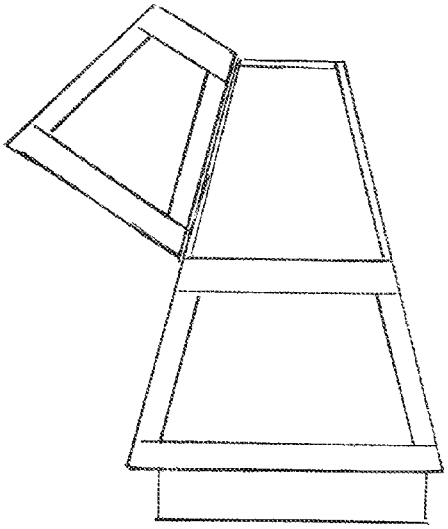

For the representative vitrine shown in FIG. 1, the lid is shown as a single door attached to one side of the vitrine. Other configurations may be employed. For example, there may be two, opposed lid portions, each pivotably attached to opposing sides of the vitrine, as shown in FIGS. 2A and 2B. These lid portions may be independently swung open or closed. Alternatively, two lid portions—an upper lid portion and a lower lid portion attached to the same side of the vitrine (akin to a double Dutch door)—may be employed as depicted in FIGS. 2C and 2D. Any combination may be used, so long as lid or lid portions may be opened or removed to allow an instrument to be placed in, and removed from, the interior of the vitrine.

Some or all of the lid or lid portions are pivotably or movably attached to the vitrine, typically using one or more hinges. Other mechanical connectors may be used to join a lid or lid portion to the vitrine so long as, as mentioned above, the lid or lid portions may be opened or removed to allow an instrument to be placed in, or removed from, the interior of the vitrine. For example, in some cases, a substantially transparent lid may be placed in, and supported by, a recess around the perimeter of the vitrine (in other words, without the presence of hinges).

In this particular version of the inventive vitrine, there is a main body 13 having the appearance of a trapezoid (when viewed from the front of the vitrine), and, underneath the trapezoid, a rectangular panel or base 15. The main body of the vitrine serves as a container for the instrument placed therein. The main body of the vitrine includes a compartment 16 in which an instrument is placed. The compartment 16 is defined by a wall (or a plurality of walls). For the representative version shown in FIG. 1, the trapezoid is defined by a bottom wall 18; a top wall 20 that is parallel to the bottom wall; and two opposing sidewalls 22 and 24 which are joined to the bottom wall and top wall. The bottom wall is longer than the top wall. The four walls together define a trapezoid that is symmetrical about an imaginary line bisecting the top wall and bottom wall.

Of course the drawing in FIG. 1 provides a 2-dimensional view of the actual vitrine. Each wall defining the compartment has a depth (i.e., a dimension perpendicular to the plane of the paper on which FIG. 1 is disposed). Typically these walls will each have substantially the same depth dimension, in which case the compartment as a whole will have the same or similar depth (depending on internal contours and shapes that may be part of the interior of the compartment). But this is not required. For example, if the vitrine is to contain a guitar, then the upper portion of the compartment may be such that the depth is different (typically shallower) than the depth of the lower portion of the compartment where the body of the guitar rests.

As noted above, for the representative version shown in FIG. 1, a trapezoidal-shaped main body 13 rests, in part, on a rectangular panel or base 15. Typically the vitrine comprises legs that contact the surface on which the vitrine rests, and which help stabilize an inclined orientation of the vitrine. These legs are not shown in FIG. 1 (but a representative version shown in FIGS. 4 and 5 display legs 50). It should be noted that while the term "legs" is used to identify this part of some representative versions of the vitrine, other extensions, stabilizers, or other components may be employed to help support the vitrine. Furthermore, a plurality of extensions or stabilizers may be used, or a single extension or stabilizer may be used.

The vitrine need not incorporate a rectangular panel or base below a main body. The trapezoid, or other shaped, main body could rest directly on the floor without a base. Of course, depending on the position of the lid on the compartment of the main body (i.e., the position of the bottom of the lid relative to the position of the bottom of the main body of the vitrine), it may be advantageous to elevate the main body. For example, if the bottom of the lid is flush with the bottom of the main body, then the bottom of the lid, or portions thereof, may contact the surface on which the vitrine rests. If so, then opening and closing the lid may be difficult, or may mar or wear the underlying surface (unless the lid is placed in a recess defined by the perimeter of the vitrine). Accordingly, certain versions of the inventive vitrine employ a base or panel.

For those versions of the vitrine in which the bottom of the lid is not flush with the bottom of the main body of the vitrine, then any contact between the bottom of the lid and the surface on which the vitrine rests typically will be reduced or eliminated. Accordingly, for embodiments of the vitrine in which the bottom of the lid is not flush with—but instead is above—the bottom of the main body of the vitrine, then the main body of the vitrine can rest directly on the floor without a base.

Figure 4:
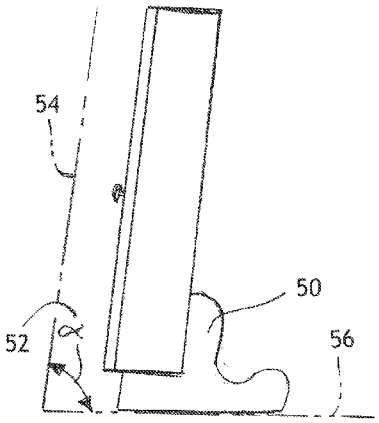
FIG. 4 shows a side view of one representative version of a free-standing vitrine of the present invention.

It should be noted, too, that contact between the lid and the surface on which the vitrine rests can be reduced or eliminated by increasing the inclination of the main body relative to the surface (see, e.g., the representative version of the vitrine depicted in FIG. 4, in which an imaginary plane through the lid of the vitrine is not perpendicular to the surface on which the vitrine rests).

The vitrine need not have a trapezoidal shape, though such a shape can be advantageous. If the vitrine is to contain a guitar, then a trapezoidal shape, like that depicted in FIG. 1, may help focus the eye of a viewer on the guitar's appearance, because the guitar, like certain trapezoids, has a wider, lower portion (i.e., the body of the guitar); and a narrower, upper portion (i.e., the neck of the guitar). Furthermore, as is discussed elsewhere, a trapezoidal cavity of sufficient size to hold a guitar can be smaller than a similarly sized rectangular cavity of sufficient size to hold the same guitar. If the interior of the vitrine is conditioned in some way (e.g., if the vitrine comprises a humidification system), then a smaller volume will require less moisture to achieve a desired humidity level.

Again, while different shapes may be used, a trapezoidal shape having a smaller upper portion and a larger lower portion can lower the center of mass of the vitrine. Typically a lower center of mass will make the vitrine more stable, including those versions of the vitrine that are inclined relative to the surface on which the vitrine rests.

Many other shapes may be employed, including shapes having curvilinear perimeters around some or all of the vitrine (e.g., a vitrine, or main body of a vitrine, that comprises a curvilinear perimeter that is similar to the perimeter of a conventional acoustic guitar); a triangular shape; a circular shape; a cylindrical shape; a coffin-like shape; a rectangular shape; or other shapes. Any shape may be used, so long as the resulting, free-standing vitrine is adapted to store an instrument so that it is viewable when the lid is closed, typically at an inclined angle relative to the plane of the surface on which the vitrine rests.

The inventive vitrine can include one or more features configured to receive and/or stabilize the instrument (i.e., an instrument-receiving assembly). For example, in the representative version shown in FIG. 1, the compartment of the main body of the vitrine includes a stand 30 and a clasp 40. The stand 30 can help elevate the instrument within the compartment of the vitrine. Furthermore, the stand can help secure or stabilize the instrument. For the embodiment shown in FIG. 1, the stand includes spaced-apart panels 32 that can support, or help constrain the movement of, an instrument. Such panels need not emanate from the stand, but could extend from another part of the vitrine (e.g., from an interior surface of a wall that helps define the compartment). Note too that other physical structures, rather than panels, may be used to help support, secure, or restrict the movement of an instrument stored in the vitrine. For example, pegs, brackets, clasps, hangers, and various other mechanical components may be used. It should also be understood that these mechanical components may be shaped to facilitate storage of an instrument. Thus, for the representative vitrine shown in FIG. 1, the spaced-apart panels comprise inclined surfaces on which the curvilinear body of a conventional acoustic or electric guitar may rest. Thus the stand may include shaped surfaces such as inclined planes, curvilinear surfaces, and other such geometries that help accommodate the shape of the particular instrument being stored in the vitrine. For the version of the inventive vitrine shown in FIG. 3, a conventional acoustic guitar 36 rests on the inclined, uppermost surfaces of these spaced-apart panels 32.

If the vitrine comprises a stand, then the stand may be hollow, with the interior cavity of the stand useable as a storage compartment. If so, then the stand will include an opening, lid, sliding door, or other feature that renders the interior cavity accessible. Note too that a humidification device or sensor, or other such device for monitoring and/or controlling an environmental condition within the vitrine may be located within or on the stand. Of course storage compartments and/or humidification devices, sensors, and the like may be placed elsewhere in or on the vitrine.

That portion of the stand that contacts the instrument may comprise a material that is soft and unlikely to mar or scratch the surface of the instrument. For example, the top most portion of the stand may comprise felt, cloth, satin, fabric, or some other material that helps reduce any marring of the instrument. If such material is employed, it may also be employed with spaced-apart panels or like features that help support the instrument (or constrain movement thereof). If desired, such materials can be attached to other portions of the vitrine (e.g., to portions of the compartment; to portions of the vitrine that contact the underlying surface; etc.).

As noted above, the vitrine embodiment shown in FIG. 1 also includes a clasp 40. In this particular embodiment, the clasp is a substantially U-shaped bracket extending outward from the back wall of the compartment. The U-shaped bracket is adapted to receive the neck of a guitar. Typically the fit of the neck into the U-shaped bracket will not be tight, thereby avoiding marring of the finish of the guitar. Furthermore, the clasp may comprise a material like felt, cloth, or other material—typically located on some portion of the inner surface of the clasp that contacts the neck of the guitar. In this way the chance of damage to, or marring of, the guitar is reduced or eliminated. As noted above, a variety of other mechanical components may be used to stabilize or receive the particular instrument stored in the vitrine. Note too that a clasp, pegs, and the like may be used alone, without a base, to support or stabilize the instrument.

Figure 3:
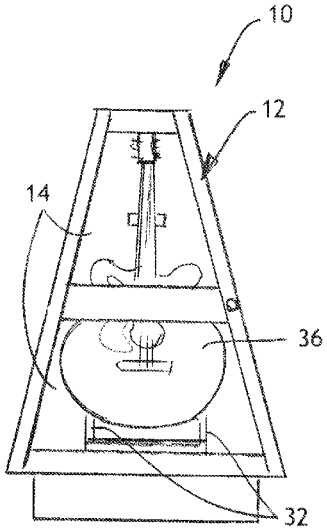
FIG. 3 shows a front view of one representative version of a free-standing vitrine of the present invention, in this case with the lid closed, and with an instrument, in this case an acoustic guitar, placed therein.

FIG. 3 shows a representative version of the vitrine with the lid closed. As discussed elsewhere, the representative version of the vitrine shown in the figures has the appearance of a trapezoid when viewed from the front (at least the main body of the vitrine has the appearance of a trapezoid). Furthermore, because the lid of the free-standing vitrine comprises transparent portions, at least some portion of the interior of the vitrine is viewable when the lid is closed. As a result, at least some portion of an instrument stored inside the vitrine is also viewable when the lid is closed. It should be understood that in some versions of the invention a single, substantially transparent piece of plastic, glass, or other material is deployed (e.g., without, as shown in FIG. 3, a horizontal component that covers some portion of the instrument contained therein).

FIG. 4 shows a side view of a representative version of the free-standing vitrine. The vitrine includes a pair of backwardly extending legs, one of which is depicted in FIG. 4 as leg 50 (the other leg is behind the depicted leg, and not shown in, FIG. 4). The legs help stabilize the vitrine. For a free-standing vitrine that is inclined relative to the surface on which the vitrine rests, as is the case for the vitrine depicted in FIG. 4, legs may not only stabilize the vitrine, they may also be necessary to stabilize the inclined orientation of the vitrine.

The distance that a leg extends from the vitrine can vary depending on the size and weight of the vitrine, and also the angle of inclination of the vitrine. The angle of inclination 52, designated as the Greek letter alpha in FIG. 4, refers to the angle between an imaginary plane 54 (with the number 54 showing a dotted line representing the imaginary plane) that is substantially parallel to the lid of the vitrine, and a second imaginary plane 56 (with the number 56 showing a second dotted line representing the second imaginary plane) that is substantially parallel to the surface on which the vitrine rests. Typically the angle of inclination of a free-standing vitrine of the present invention will be between 90 degrees and 45 degrees; suitably between 90 degrees and 60 degrees; particularly between 85 degrees and 65 degrees. As the angle of inclination decreases, the length of the legs may be increased to help stabilize the vitrine. Note, however, that some versions of the vitrine may not include legs for this purpose. And, as noted above, other mechanical components, extensions, stabilizers, or the like may be used.

In some versions of the invention, the angle of inclination of the vitrine is adjustable. An adjustable angle of inclination may be accomplished using any combination of mechanical, electrical, pneumatic, or other devices known in the art. For example, legs attached to the main body or compartment of the vitrine may be movably attached to the vitrine (e.g., by hinges). In this way, the main body of the vitrine may be moved relative to the legs so that the angle of inclination may be adjusted. Of course the selected angle of inclination should be capable of being secured in place. This may be done using a variety of mechanical locking devices, including frictional locking devices (e.g., hand tightening a knurled knob so that further movement or pivoting of the main body of the vitrine relative to the legs is stopped) and positive locking devices (e.g., insertion of a boss, bolt, pin, or other component into a hole or recess so that further movement or pivoting of the main body of the vitrine relative to the legs is stopped). Any conventional mechanical components for adjusting, and locking into place, a desired angle of inclination may be deployed, so long as the free-standing instrument vitrine is stable within the range of inclinations available to a user.

Typically the minimum distance between the plane on which the vitrine rests, and the highest point on the vitrine is between 36 inches and 72 inches; suitably between 45 inches and 65 inches. This distance, of course, depends on the size of the vitrine (which depends on the particular instrument, or instruments, the vitrine is configured to house), and the angle of inclination of the vitrine. For smaller instruments, such as a violin, the main body of the vitrine may be elevated by a stand, so long as the resulting combination is stable. In such cases the aforementioned distances may increase.

Figure 5:
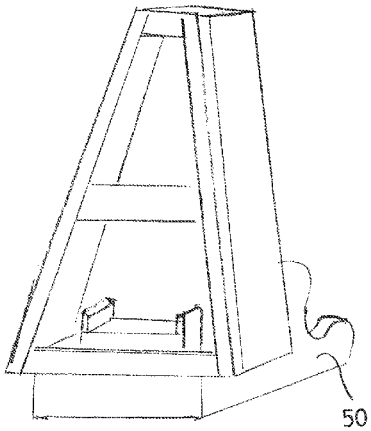
FIG. 5 shows a perspective view of one representative version of a free-standing vitrine of the present invention.

FIG. 5 shows a perspective view of a free-standing vitrine of the present invention.

Often a free-standing vitrine of the present invention comprises a substantially rigid material such as wood, metal, or plastic. Such substantially rigid materials help safeguard an instrument stored inside the vitrine. Depending on the instrument stored inside the vitrine, the ratio of the mass of the vitrine to the mass of the instrument stored inside the vitrine will typically be significantly greater than 1; particularly greater than 5; suitably greater than 10. For example, a conventional acoustic guitar typically weighs less than 10 pounds (e.g., some types of guitars weight between 3 and 7 pounds, depending on the material with which the guitar is constructed; and the size of the guitar). The version of the free-standing vitrine like that depicted in FIG. 1, and comprising wood and glass, and sized to contain the guitar, could weigh between 20 pounds and 70 lbs, or more. Of course the recited masses and ratios can vary, depending on the materials of construction, and the identity of the particular instrument being stored in the vitrine. Suffice it to say that the mass of a free-standing vitrine of the present invention will typically exceed, perhaps substantially so, the mass of portable cases used to carry and store instruments of different kinds, such as guitars, saxophones, violins, or other instruments.

Accordingly, in some versions of the invention, the free-standing instrument vitrine is movable. If the vitrine is to be placed on a hard surface, such as a hardwood floor, then felt, Teflon, or other material may be placed on some or all of the bottom of the vitrine (including any legs, stabilizers, or other vitrine components that contact the surface on which the vitrine rests). The selected material will generally reduce the coefficient of friction between the vitrine and the surface on which the vitrine rests and, ideally, substantially eliminate marring or damage to the surface when the vitrine is moved. Alternatively, a wheel assembly, such as caster-and-wheel assemblies, may be positioned at the bottom of the vitrine and any legs attached to the vitrine. The wheel assemblies may either be integrally attached to the vitrine, or removably attached to the vitrine. In some versions of the invention, the vitrine comprises recessed wheel assemblies that may be deployed in order to move the vitrine on the rolling wheels. Once the vitrine is moved to a desired location, the wheel assemblies may be positioned in a recessed configuration. If wheel assemblies are used, then the vitrine may also include mechanical components that lock one or more of the wheel assemblies so that further movement is not possible, or is restricted, when the wheel is locked. Any conventional locking component known in the art may be used. Alternatively, recessed wheel assemblies, when not deployed so that the vitrine can roll, my be sufficiently recessed in the vitrine (e.g., in the bottom portion of the base or main body; and/or in any legs or stabilizers attached to the vitrine), such that the vitrine is not readily movable.

Various methods of construction may be used to make the vitrine. For example, conventional tools and processes may be used to cut, shape, mold, and/or finish wood, metal, plastic, glass, transparent plastic such as Plexiglas-brand materials, fabric, or other components, alone or in combination, that are subsequently assembled to make the vitrine. The components may be joined in various ways known in the art. For example, components may be attached to one another using fastening hardware such as screws, nails, bolts, clamps, and other such hardware; glue or adhesive; welding or other fusing methods; or other conventional attachment components or methods known in the art of making and assembling structures from materials like those identified above. As may be seen from the above description of the vitrine itself, one version of a method of making the present invention includes the step of attaching to a container a lid through which the interior of the container is viewable. Furthermore, the lid is inclined relative to the surface on which the vitrine rests. In many embodiments, a method of the present invention also includes the step of attaching legs to the container. The legs serve to help stabilize the vitrine in an inclined position.

As for any materials employed in the lid that render viewable at least portions of an instrument stored inside the vitrine, the materials may be composed of a chemical composition that reduces or eliminates the passage of certain wavelengths of light through the material. Embodiments of the vitrine that employ such transparent or substantially transparent materials can help reduce photodegradation of an instrument stored inside the vitrine. Furthermore, the transparent or substantially transparent materials may be tinted for aesthetic or other purposes.

Some versions of the inventive vitrine may comprise one or more sensors that detect and provide a cue as to conditions within the vitrine. For example, the vitrine may comprise a digital or analog thermometer that senses and displays the temperature within the vitrine. Alternatively, or in addition to, a temperature sensor, the vitrine may comprise a sensor that detects and displays the amount of water vapor (e.g., relative humidity) within the vitrine. The dimensions of, and therefore the sounds made by, a wooden instrument such as a guitar are affected by environmental conditions (e.g., the amount of moisture in the air).

Some versions of the inventive vitrine may comprise a device that helps promote or maintain a desired condition within the vitrine. For example, a humidification device may be employed to help promote a desired humidity level within the vitrine. The device may be simple, such as a porous stone or sponge into which water is introduced, or more sophisticated. Such a device can be linked to a sensor to provide for an automated system for regulating the environmental condition, such as humidity. Or the vitrine may comprise a device, such as a humidification device, and a sensor, such as a hygrometer, with a user manually actuating or controlling the humidification device depending on the humidity measurement being displayed by the sensor.

Because some instruments are sensitive to environmental conditions as described above, the fit between the lid and the vitrine may be fashioned so that the environmental conditions inside the vitrine are more readily controlled or maintained to a desired condition. For example, a gasketing material may be interposed between the inner surface of the lid and the main body of the vitrine, thereby achieving a better seal between the lid and the main body of the vitrine. Thus a thin rubber strip may be attached to one or both of the lid, and that portion of the vitrine that contacts the lid, to achieve a better seal. Any suitable gasketing material may be used to help reduce or eliminate the interchange of air between the environment within the vitrine, and the environment outside the vitrine.

It should be understood that the embodiments of the invention herein described are merely illustrative of the applications of the principles of the invention. Reference herein to details of the illustrated embodiments is not intended to limit the scope of the claims.

We claim:

1. A free-standing instrument vitrine comprising:

an inclined container configured to receive and display a musical instrument, the container comprising:

a bottom wall having a bottom wall length;

a top wall having a top wall length;

a first side wall connecting the bottom wall to the top wall, the first side wall having a first side wall length;

a second side wall connecting the bottom wall to the top wall, the second side wall having a second side wall length;

wherein the first side wall length is substantially the same as the second side wall length, and wherein the bottom wall length is greater than the top wall length;

legs attached to, and extending from, the container;

a lid attached to the container by a hinge, wherein at least a portion of the interior of the container is viewable through the lid, and wherein the container comprises wood, metal, or plastic, and wherein the lid further comprises glass;

a humidification device; and a humidity detector.

2. The vitrine of claim 1 wherein the lid comprises transparent plastic.

3. The vitrine of claim 1 wherein the back of the inclined container is at an angle between 45 degrees and 90 degrees relative to a floor on which the vitrine stands.

4. The vitrine of claim 1 wherein the minimum distance from a surface on which the vitrine rests to the highest point on the vitrine is between 36 inches and 72 inches.

5. The vitrine of claim 1 further comprising an instrument-receiving assembly.

6. The vitrine of claim 1 wherein the inclined container is characterized by an angle of inclination, and the angle of inclination is adjustable.

7. The vitrine of claim 1 further comprising a wheel assembly.

8. The vitrine of claim 1 wherein the ratio of the mass of the vitrine to the mass of the instrument is between 2 to 1 and 10 to 1.

9. The vitrine of claim 1 further comprising a gasketing material interposed between the lid and the container.

10. The vitrine of claim 1 having a perimeter wherein at least a portion of the perimeter is curvilinear.

* * * * *